US006765485B2

(12) United States Patent
Lee et al.

(10) Patent No.: US 6,765,485 B2
(45) Date of Patent: Jul. 20, 2004

(54) COMPUTER AND DATA COMMUNICATION CONTROL METHOD THEREOF

(75) Inventors: Byung-Lae Lee, Suwon (KR); Hyung-Jun Kim, Suwon (KR); Houk Wang, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 273 days.

(21) Appl. No.: 10/057,902

(22) Filed: Jan. 29, 2002

(65) Prior Publication Data

US 2002/0163931 A1 Nov. 7, 2002

(30) Foreign Application Priority Data

May 7, 2001 (KR) ..... 2001/24677
Jul. 26, 2001 (KR) ..... 2001/45174

(51) Int. Cl.[7] ..... G08B 1/00

(52) U.S. Cl. ..... 340/531; 340/568.6; 340/568.4; 340/686.1; 340/687; 340/686.4

(58) Field of Search ..... 340/531, 533, 340/568.2, 568.4, 568.1, 679, 686.1, 687, 686.4, 693.5; 439/676, 493; 361/686, 600; 709/250; 710/301

(56) References Cited

U.S. PATENT DOCUMENTS 5,501,608 A 3/1996 Scheer et al. ..... 439/218
5,909,596 A 6/1999 Mizuta
6,115,755 A 9/2000 Krishan ..... 709/250
6,164,989 A 12/2000 Glad et al. ..... 439/131
6,404,626 B1 * 6/2002 Low et al. ..... 361/686
6,457,994 B1 * 10/2002 Johnson et al. ..... 439/492

FOREIGN PATENT DOCUMENTS

JP 06-085848 3/1994
JP 07-281803 10/1995
JP 09-179802 7/1997
JP 10-069339 3/1998
JP 2001-109697 A 4/2001

* cited by examiner

*Primary Examiner*—Daryl Pope
(74) *Attorney, Agent, or Firm*—Robert E. Bushnell, Esq.

(57) ABSTRACT

A computer system equipped with a LAN signal processing part and a modem signal processing part comprises: a common connector to which an external LAN connector to be connected to the LAN signal processing part and an external modem connector to be connected to the modem signal processing part are selectively connected; a connector detector provided at the common connector for detecting which of the external LAN connector and the external modem connector is connected to the common connector; and a control part for controlling a predetermined signal to be transmitted to one of the LAN signal processing part and the modem signal processing part in correspondence to the external connector detected by the connector detector. With this configuration, the cost of production decreases, and space for an installation of hardware components is more plentiful.

16 Claims, 5 Drawing Sheets

COMPUTER AND DATA COMMUNICATION CONTROL METHOD THEREOF

CLAIM OF PRIORITY

This application makes reference to, incorporates the same herein, and claims all benefits accruing under 35 U.S.C. § 119 from my two applications one of which is entitled COMPUTER AND METHOD FOR DATA COMMUNICATION CONTROLLING THE SAME filed with the Korean Industrial Property Office on 7 May 2001 and there duly assigned Serial No. 24677/2001, and the other of which is entitled COMPUTER AND METHOD FOR DATA COMMUNICATION CONTROLLING THE SAME, filed with the Korean Industrial Property Office on 26 Jul. 2001 and there duly assigned Serial No. 45174/2001.

BACKGROUND OF THE INVENTION

1. Technical Field

The present invention relates, in general, to a computer and a data communication control method thereof.

2. Related Art

Computer systems include a desktop computer system and a portable computer system. The portable computer system is described below by way of example.

The portable computer system comprises a computer body accommodating a plurality of hardware components, such as a central processing unit (CPU) contained in a casing thereof, and a liquid crystal display (LCD) for displaying a picture as a result of a video signal outputted from the computer body.

On a side of the casing, there are provided PS/2 ports to which a mouse and a keyboard are connected, a compact disk read only memory (CD-ROM) drive or a floppy disk drive (FDD), and a local area network (LAN) connector and a modem connector for communicating with external devices. An external LAN connector is connected to the LAN connector for LAN communication, and an external modem connector is connected to the modem connector for modem communication through a telephone line.

With this configuration, in the portable computer system, the external LAN connector and the external modem connector are connected to the LAN connector and the modem connector, respectively.

However, in the portable computer system, the side of the casing has a limited amount of space for the installation of hardware components. Nevertheless, within the limited space, the LAN connector and the modem connector (to which the external LAN connector and the external modem connector, respectively, are connected) should be provided because the external LAN connector to be connected to the LAN connector and the external modem connector to be connected to the modem connector are similar to each, other with respect to connection, but are different from each other with respect to the number of pins in that the external LAN connector has 8 pins and the external modem connector has 4 pins. As described above, in the portable computer system, because the connectors are provided on the casing, the external appearance of the casing appeares complicated, the space for installation of hardware components is narrow, and the cost of production increases.

The following are considered to be generally pertinent to the present invention but are burdened by the disadvantages set forth above: U.S. Pat. No. 5,501,608 to Scheer et al., entitled COMPUTER SYSTEM WITH AN INTERCONNECTION RECEPTABLE SUITABLE FOR DIFFERENT EXTERNAL CONNECTORS, issued on Mar. 26, 1996, U.S. Pat. No. 6,115,755 to Krishan, entitled INTEGRATED APPARATUS FOR INTERFACING SEVERAL COMPUTERS TO THE INTERNET THROUGH A SINGLE CONNECTION, issued on Sep. 5, 2000, U.S. Pat. No. 6,164,989 to Glad et al., entitled ADAPTABLE COMMUNICATIONS CONNECTORS, issued on Dec. 26, 2000, and Japanese Patent Publication No. 06-85848 to Tsukamoto, entitled COMMUNICATION EQUIPMENT, published on 25 Mar. 1994.

SUMMARY OF THE INVENTION

Accordingly, the present invention has been developed with the above-described shortcoming and the needs of the user in mind. An object of the present invention is to provide a computer and a data communication control method thereof, in which the external appearance of the connector is simplified, the cost of production is decreased, and space for installation of hardware components is plentiful.

This and other objects of the present invention are accomplished by the provision of a computer system equipped with a LAN signal processing part and a modem signal processing part, the system comprising: a common connector to which an external LAN connector to be connected to the LAN signal processing part and an external modem connector to be connected to the modem signal processing part are selectively connected; a connector detector provided at the common connector for detecting which of the external LAN connector and the external modem connector is connected to the common connector; and a control part for controlling a predetermined signal to be transmitted to one of the LAN signal processing part and the modem signal processing part in correspondence to the external connector detected by the connector detector.

Preferably, the common connector includes common pins employed for both the LAN signal processing part and the modem signal processing part, and exclusive pins employed for only the LAN signal processing part, and the connector detector is provided on an inside wall of the common connector, and outputs a detection signal in response to contact with the external LAN connector.

Further, the control part comprises a bi-state relay switch which controls the predetermined signal to be transmitted to one of the LAN signal processing part and the modem signal processing part in correspondence to the external connector detected by the connector detector.

The bi-state relay switch includes negative and positive sides, common terminals connected with the common pins, LAN selecting terminals for connection to the LAN signal processing part, and modem selecting terminals for connection to the modem signal processing part. The common terminals of the negative and positive sides are connected to the LAN selecting terminals or the modem selecting terminals in correspondence to the external connector detected by the connector detector.

Preferably, the LAN signal processing part and the modem signal processing part are provided on a main board, and the common connector is provided at a side of the main board.

Further, the LAN and modem signal processing parts are provided on a combination card, and the combination card includes the connector detector and the control part.

According to another aspect of the present invention, the above and other objects may be also achieved by the provision of a method of controlling data communication of a computer system equipped with a LAN signal processing part and a modem signal processing part, the method comprising the steps of: providing a common connector to which an external LAN connector to be connected to the LAN signal processing part and an external modem connector to be connected to the modem signal processing part are selectively connected; connecting one of the external LAN connector and the external modem connector to the common connector; detecting the kind of external connector connected to the common connector; and controlling a predetermined signal to be transmitted to one of the LAN signal processing part and the modem signal processing part in correspondence to the external connector detected by the connector detector.

BRIEF DESCRIPTION OF THE DRAWINGS

A more complete appreciation oft he invention, and many of the attendant advantages thereof, will be readily apparent as the same becomes better understood by reference to the following detailed description when considered in conjunction with the accompanying drawings, in which like reference numerals indicate the same or similar components, and wherein.

DETAILED DESCRIPTION OF PREFERRED EMBODIMENT

The present invention will be described in more detail with reference to the accompanying drawings.

Figure 1:
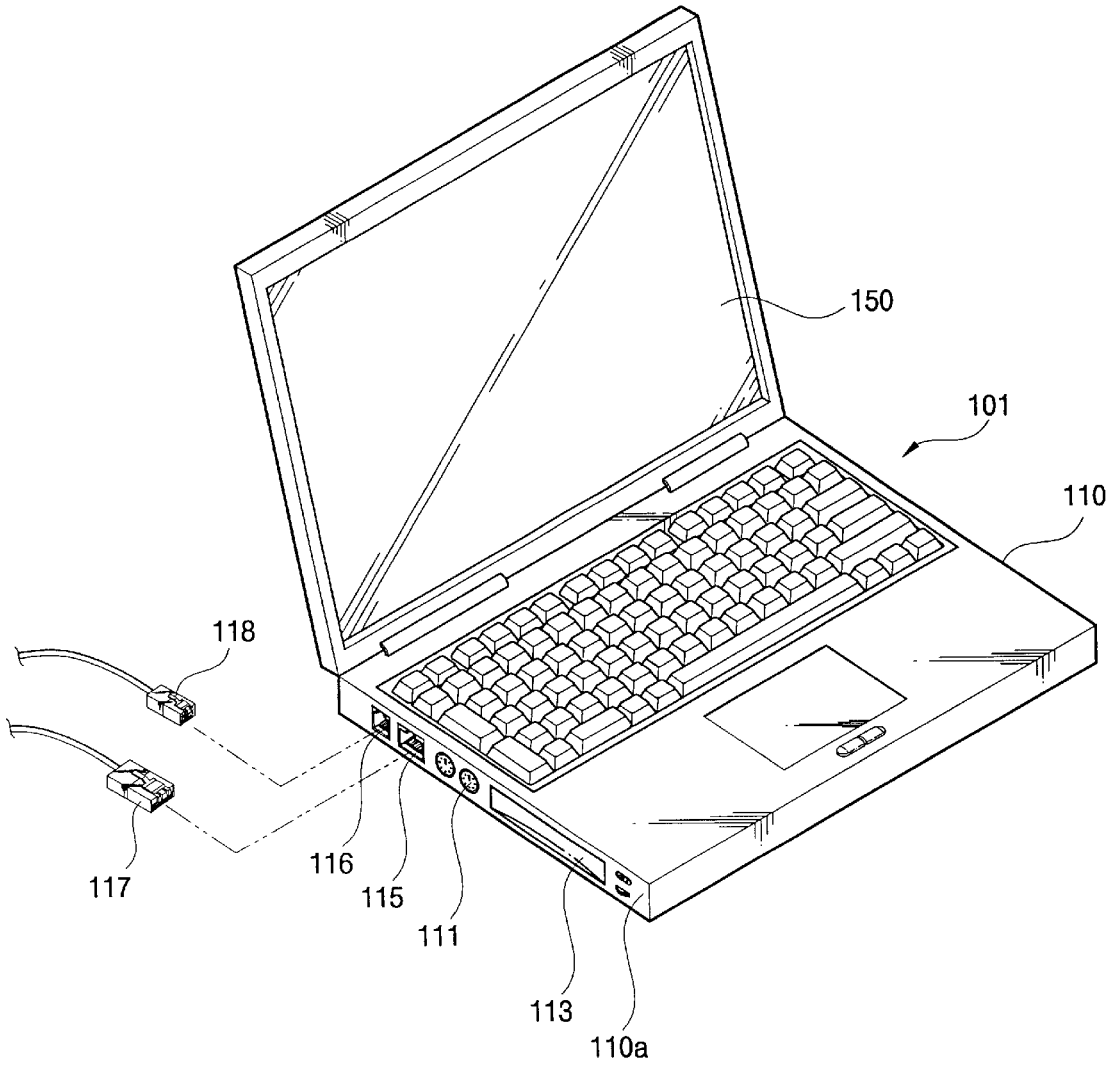
FIG. 1 is a perspective view of a portable computer system.

FIG. 1 is a perspective view of a portable computer system. Referring to FIG. 1, the portable computer system comprises a computer body 101 accommodating a plurality of hardware components, such as a central processing unit (CPU) contained in a casing 110 thereof, and a liquid crystal display (LCD) 150 for displaying a picture as a result of a video signal outputted from the computer body 101 thereon.

On a side 110*a* of the casing 110, there are provided PS/2 ports to which a mouse and a keyboard are connected, a compact disk read only memory (CD-ROM) drive 113 or a floppy disk drive (FDD) (not shown), and a local area network (LAN) connector (RJ45) 115 and a modem connector (RJ11) 116 for communicating with external devices. An external LAN connector (RJ45) 117 is connected to the LAN connector 115 for LAN communication, and an external modem connector (RJ11) 118 is connected to the modem connector 116 for modem communication through a telephone line.

With this configuration, in the portable computer system, the external LAN connector 117 and the external modem connector 118 are connected to the LAN connector 115 and the modem connector 116, respectively.

However, in this portable computer system, the side 110*a* of the casing 110 has a limited amount of space for the installation of hardware components. Nevertheless, within the limited space the LAN connector 115 and the modem connector 116 (to which the external LAN connector 117 and the external modem connector 118, respectively, are connected) should be provided because the external LAN connector 117 to be connected to the LAN connector 115 and the external modem connector 118 to be connected to the modem connector 116 are similar to each other with respect to connection, but are different from each other with respect to the number of pins in that the external LAN connector 117 has 8 pins and the external modem connector 118 has 4 pins.

As described above, in the portable computer system, because the connectors are provided on the casing, the external appearance of the casing appears complicated, the space for installation of hardware components is narrow, and the cost of production increases.

Figure 2:
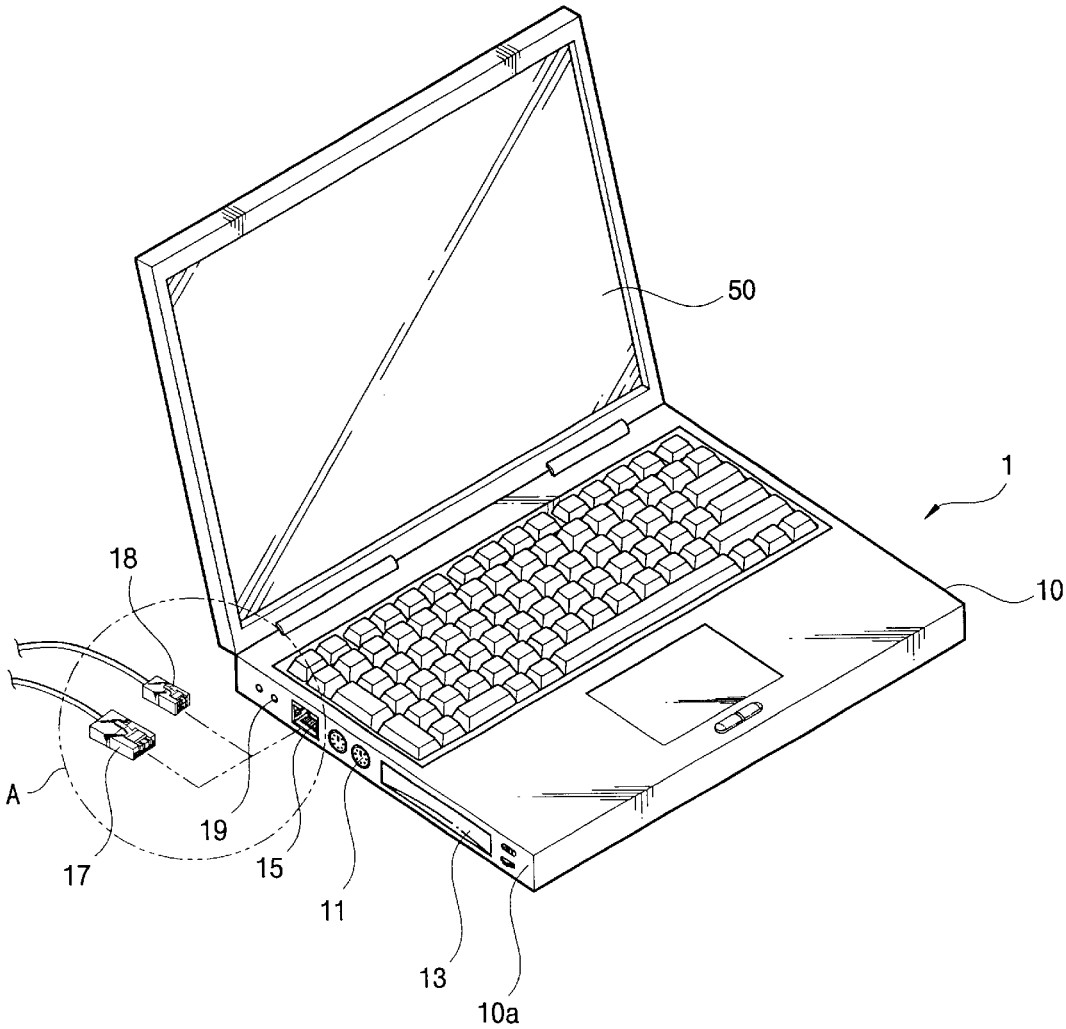
FIG. 2 is a perspective view of a portable computer system according to the present invention.
Figure 3:
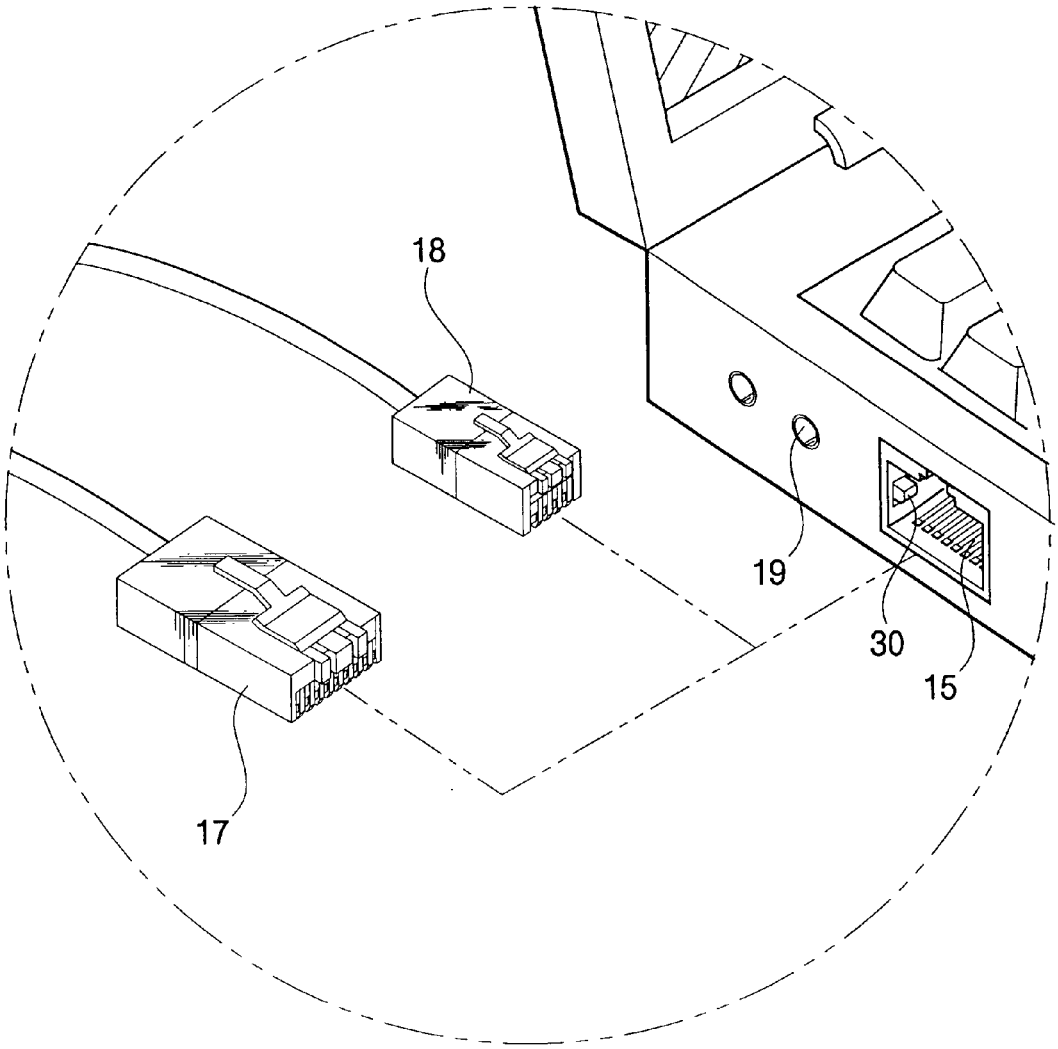
FIG. 3 is an enlarged perspective view of a portion "A" of FIG. 2.

FIG. 2 is a perspective view of a portable computer system according to the present invention, while FIG. 3 is an enlarged perspective view of portion "A" of FIG. 2. Referring to FIGS. 2 and 3, the portable computer system according to the present invention comprises a computer body 1 equipped with a plurality of hardware components, such as a central processing unit (CPU) and an LCD 50 for displaying a picture as a result of a video signal outputted from the computer body 1.

The computer body 1 includes a casing 10 forming an external appearance thereof and a plurality of hardware components, such as a main board 20 (see FIG. 4) accommodated in the casing 10.

On a side 10*a* of the casing 10, as shown in FIG. 2, there are provided PS/2 ports 11 by means of which a mouse and a keyboard are connected, a CD-ROM drive 13 or a floppy disk drive (FDD) (not shown), a sound jack 19 through which a sound is outputted, and a common connector 15 to which an external LAN connector 17 or an external modem connector 18 is connected for communication with external devices.

The common connector 15, as shown in FIGS. 2 and 3, is constructed such that the external LAN connector 17, generally having 8 pins, and the external modem connector 18, generally having 4 pins, are selectively connected thereto. Thus, the common connector 15 is of a shape corresponding to the 8 pins so as to be selectively connected to the external LAN connector 17 and the external modem connector 18, and has a connector detector 30 for detecting which of the external LAN connector 17 and the external modem connector 18 is connected thereto.

The external modem connector 18 may have 2, 4 or 6 terminals, but only the central two terminals ($4^{th}$ and $5^{th}$ terminals) are employed for transmitting a signal, whereas the external LAN connector 17 employs all eight terminals.

Accordingly, $1^{st}$, $2^{nd}$, $3^{rd}$, $6^{th}$, $7^{th}$, and $8^{th}$ pins of the common connector 15 are exclusively employed for a LAN connection, whereas $4^{th}$ and $5^{th}$ pins of the common connector 15 are selectively employed for the LAN connection and the modem connection.

The connector detector 30, as shown in FIG. 3, comprises a contact switch provided on an inside wall of the common connector 15, and detects which of the external LAN connector 17 and the external modem connector 18 is inserted in the common connector 15 depending on the pressing force of the external LAN connector 17 or the external modem connector 18. That is, if the external LAN connector 17 is inserted into the common connector 15, the external LAN connector 17 presses against the connector detector 30 so that a high signal is transmitted to a bi-state relay switch (or control part) 40 via a PNP transistor 35 (see FIG. 4). Further, if the external modem connector 18 is inserted into the common connector 15, the external modem connector 18 does not press against the connector detector 30 so that a low signal is transmitted to the bi state relay switch 40 via the PNP transistor 35.

The PNP transistor 35 is provided between the connector detector 30 and the bi-state relay switch 40, and outputs a connector detection signal outputted from the connector detector 30 to a negative terminal of the bi-state relay switch 40.

As a control part, the bi-state relay switch 40 has two states and two channels. The bi-state relay switch 40 comprises a positive side to which a voltage Vcc is applied, a negative side to which a signal from connector detector 30 is applied via the PNP transistor 35, common terminals 1S2 and 2S2 (see FIG. 4) connected with the common pins ($4^{th}$ and $5^{th}$) of the common connector 15, LAN selecting terminals 1S3 and 2S3 connected to a LAN signal processing part 21 for LAN communication, and modem selecting terminals 1S1 and 2S1 connected to a modem signal processing part 23 for modem communication.

Figure 4:
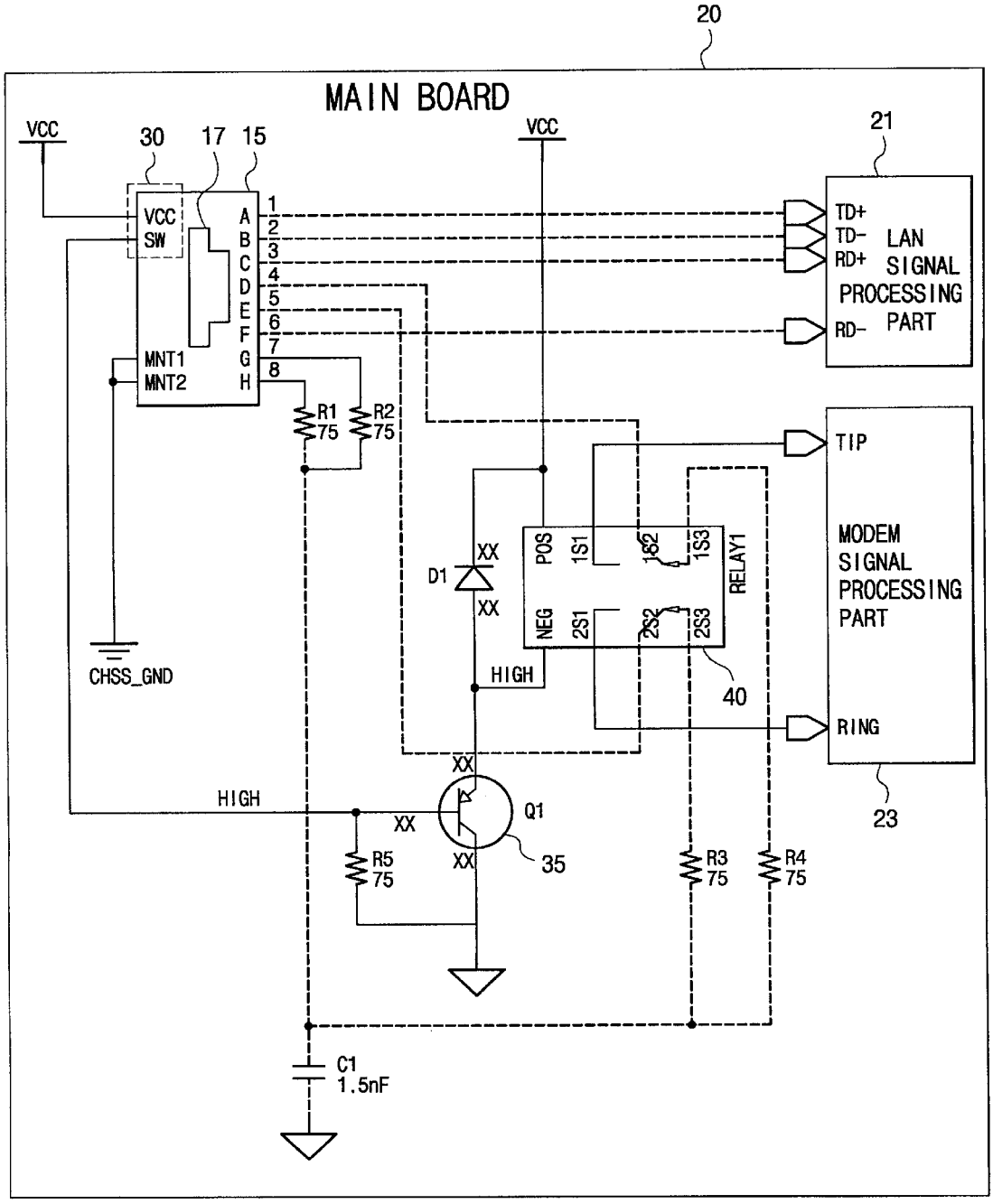
FIGS. 4 and 5 are circuit diagrams showing a communication circuit of a portable computer system according to the present invention.
Figure 5:
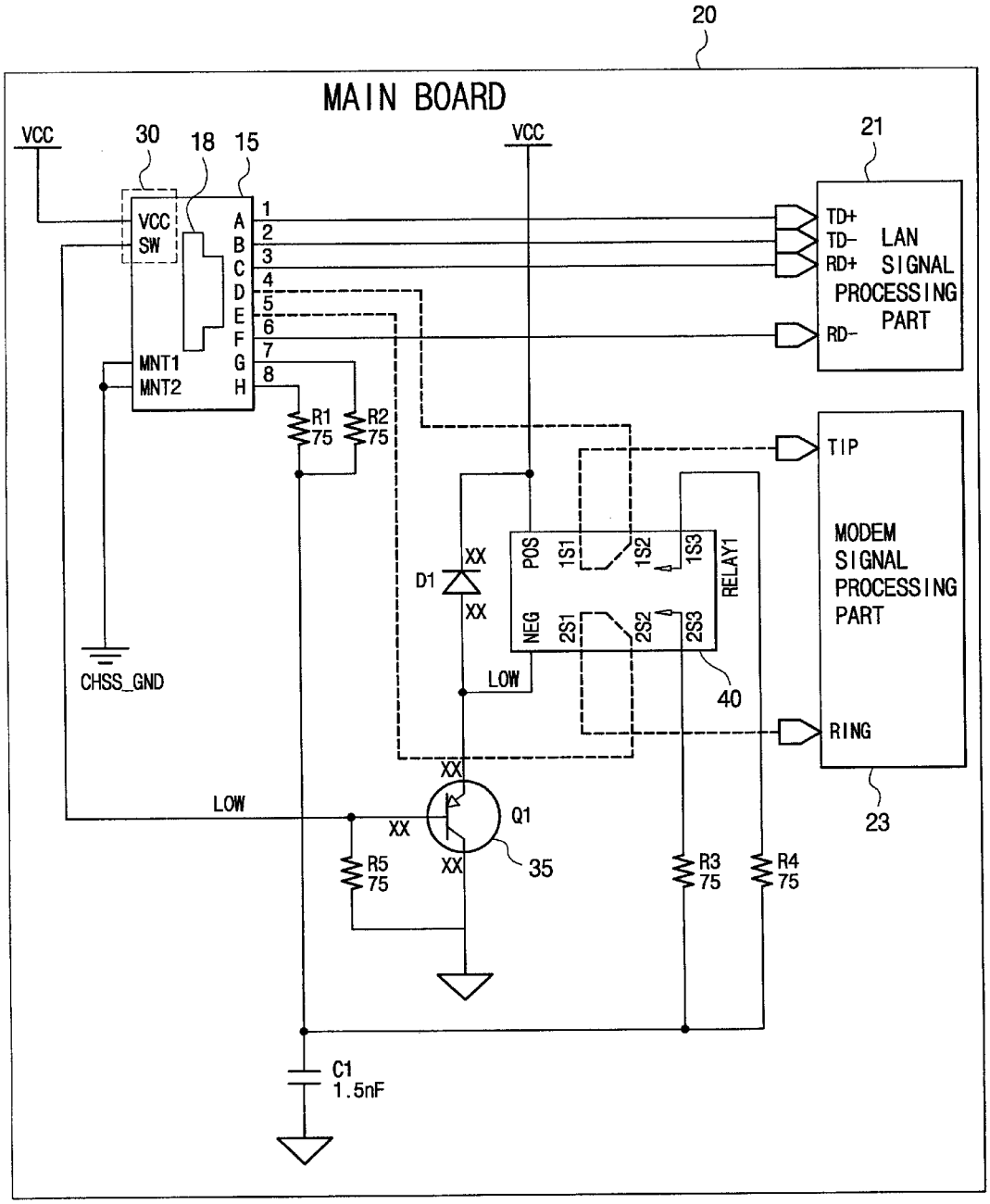

FIGS. 4 and 5 are circuit diagrams showing a communication circuit of the portable computer system according to the present invention. Therein, a connection state of the positive side is changed depending on a connection state of the negative side. As shown in FIG. 4, the bi-state relay switch 40 may comprise a mechanical relay or an MOS transistor.

To the negative side, a high or low signal from the connector detector 30 is inputted in correspondence to detection of the connector 17 or 18 by the connector detector 30. In the case of a high signal input, the common terminal 2S2 of the negative side is, as shown in FIG. 4, connected to the LAN selecting terminal 2S3 so as to be connected to a ground terminal via resistor R3. Furthermore, in the case of a low signal input, the second common terminal 2S2 of the negative side is, as shown in FIG. 5, connected to the modem selecting terminal 2S1. On the other hand, according to the connection state of the negative side, the common terminal 1S2 of the positive side is connected to the LAN selecting terminal 1S3 in the case of a high signal input (see FIG. 4), and the common terminal 1S2 of the positive side is connected to the modem selecting terminal 1S1 in the case of a low signal input (see FIG. 5).

With this configuration, the operation of the circuit for insertion of the external LAN connector 17 or the external modem connector 18 into the common connector 15 will be described with reference to FIGS. 4 and 5.

First, according to the present invention, on the main board 20, which is equipped with the LAN signal processing part 17 and the modem signal processing part 18, a common connector 15 into which the external LAN connector 17 and the external modem connector 18 are selectively inserted is provided. Then, according to the present invention, one of the external LAN connector 17 and the external modem connector 18 is inserted into common connector 15 so as to communicate with external devices. When one of the external LAN connector 17 and the external modem connector 18 is inserted into the common connector 15, the connector detector 30 detects which of the external LAN connector 17 and the external modem connector 18 is inserted into the common connector 15, and outputs a connector detection signal to the PNP transistor 35. The detecting process is performed in the above-described manner. That is, if the external LAN connector 17 or the external modem connector 18 is inserted into the common connector 15, the connector detector 30 outputs a high signal (for the LAN) or a low signal (for the modem).

As shown in FIG. 4, if the external LAN connector 17 is inserted into the common connector 15, the connector detector 30 transmits the high signal to the PNP transistor 35. Then, the PNP transistor 35 transmits the high signal to the negative side of the bi-state relay switch 40. In accordance with the high signal, the common terminal 2S2 of the negative side is connected to the LAN selecting terminal 2S3 which is connected to the ground terminal via resistor R3. Thus, a signal transmitted through the 5th pin of the common connector 15 is transmitted to the ground terminal via the LAN selecting terminal 2S3.

Further, with respect to the connection state of the negative side, the common terminal 1S2 of the positive side is connected to the LAN selecting terminal 1S3. Thus, a signal transmitted through the 4th pin of the common connector 15 is transmitted to the ground terminal via the LAN selecting terminal 1S3 and resistor R4.

Consequently, the $1^{st}$, $2^{nd}$, $3^{rd}$, and $6^{th}$ pins of the common connector 15 are directly connected to the LAN signal processing part 21 so that signals transmitted through the $1^{st}$, $2^{nd}$, $3^{rd}$, and $6^{th}$ pins are directly transmitted to the LAN signal processing part 21. The $7^{th}$ and $8^{th}$ pins are connected to the ground terminal via resistors R1 and R2, respectively, so that signals transmitted through the $7^{th}$ and $8^{th}$ pins are transmitted to the ground terminal. The signals transmitted through the $4^{th}$ and $5^{th}$ pins are transmitted to the ground terminal via the bi-state relay switch 40 and resistors R4 and R3, respectively. Accordingly, the signals through the $4^{th}$, $5^{th}$, $7^{th}$ and $8^{th}$ pins are transmitted to the ground terminal, and the signals through the $1^{st}$, $2^{nd}$, $3^{rd}$ and $6^{th}$ pins are transmitted to the LAN signal processing part 21, thereby adapting the computer body 1 for LAN communication.

As shown in FIG. 5, if the external modem connector 18 is inserted into the common connector 15, the connector detector 30 transmits a low signal to the PNP transistor 35. Then, the PNP transistor 35 transmits a low signal to the negative side of the bi-state relay switch 40. According to the low signal, the common terminal 2S2 of the negative side is connected to the modem selecting terminal 2S1 which is connected to the modem signal processing part 23. Thus, a signal transmitted through the 5th pin of the common connector 15 is transmitted to the modem signal processing part 23 via the modem selecting terminal 2S1.

Furthermore, with respect to the connection state of the negative side, the common terminal 1S2 of the positive side is connected to the modem selecting terminal 1S1. Thus, a signal transmitted through the 4th pin of the common connector 15 is transmitted to the modem signal processing part 23 via the modem selecting terminal 1S1.

Accordingly, the signals through the 4th and 5th pins are transmitted to the modem signal processing part 23, thereby adapting the computer body 1 for modem communication.

In the above description, the LAN signal processing part 21 and the modem signal processing part 23 are provided on the main board 20. However, the LAN signal processing part 21 and the modem signal processing part 23 may be provided on a combination card (not shown). In this case, the common connector 15, the control part 40, and the connector detector 30 are provided on the combination card.

In the above description, the present invention is applied to a portable computer system, but it may be applied to a desktop computer system as well.

That is, the present invention provides a computer system comprising a common connector to which an external LAN connector and an external modem connector are selectively connected, a connector detector for detecting the type of external connector connected to the common connector, and a control part for controlling a signal to be transmitted to a LAN signal processing part or a modem signal processing part in correspondence to the connected external connector.

As described above, the present invention provides a computer and a data communication control method thereof in which the external appearance of the connector is simplified, the cost of production is decreased, and space for installation of hardware components is plentiful.

Although the preferred embodiments of the present invention have been described, it will be understood by those skilled in the art that the present invention should not be limited to the described preferred embodiment. Rather, various changes and modifications can be made within the spirit and scope of the present invention, as defined by the following claims.

What is claimed is:

1. A computer system equipped with a LAN signal processing part and a modem signal processing part, comprising:

a common connector to which an external LAN connector to be connected to the LAN signal processing part and an external modem connector to be connected to the modem signal processing part are selectively connected;

a connector detector provided at the common connector for detecting which of the external LAN connector and the external modem connector is connected to the common connector; and a control part for controlling a predetermined signal to be transmitted to one of the LAN signal processing part and the modem signal processing part in correspondence to the external connector detected by the connector detector.

2. The computer system according to claim 1, wherein the common connector includes common pins employed for both the LAN signal processing part and the modem signal processing part, and exclusive pins employed for only the LAN signal processing part.

3. The computer system according to claim 1, wherein the connector detector is provided on an inside wall of the common connector, and outputs a detection signal in response to contact with the external LAN connector.

4. The computer system according to claim 1, wherein the control part comprises a bi-state relay switch which controls a predetermined signal to be transmitted to one of the LAN signal processing part and the modem signal processing part in correspondence to the external connector detected by the connector detector.

5. The computer system according to claim 4, wherein the bi-state relay switch includes negative and positive sides, common terminals connected to the common pins, LAN selecting terminals for connection to the LAN signal processing part, and modem selecting terminals for connection to the modem signal processing part; and the common terminals of the negative and positive sides are connected to one of the LAN selecting terminals and the modem selecting terminals in correspondence to the external connector detected by the connector detector.

6. The computer system according to claim 2, wherein the control part comprises a bi-state relay switch which includes negative and positive sides, common terminals connected to the common pins, LAN selecting terminals for connection to the LAN signal processing part, and modem selecting terminals for connection to the modem signal processing part; and the common terminals of the negative and positive sides are connected to one of the LAN selecting terminals and the modem selecting terminals in correspondence to the external connector detected by the connector detector.

7. The computer system according to claim 1, further comprising a main board, wherein the LAN signal processing part and the modem signal processing part are provided on the main board, and the common connector is provided at a side of the main board.

8. The computer system according to claim 1, further comprising a combination card, wherein the LAN and modem signal processing parts are provided on the combination card, and the combination card includes the connector detector and the control part.

9. The computer system according to claim 1, wherein the connector detector outputs a first detection signal in response to contact with the external LAN connector and a second detection signal in response to contact with the external modem connector.

10. The computer system according to claim 1, wherein the control part comprises:

a switch having at least one input connected to an output of said connector detector, and having outputs connected to said LAN signal processing part and said modem signal processing part, respectively; and a transistor having an input connected to a further output of said connector detector, and having an output connected to positive and negative inputs of said switch.

11. The computer system according to claim 10, wherein said switch controls a predetermined signal to be transmitted to one of the LAN signal processing part and the modem signal processing part in correspondence to the external connector detected by the connector detector.

12. The computer system according to claim 10, wherein the common connector includes common pins employed for both the LAN signal processing part and the modem signal processing part, and exclusive pins employed for only the LAN signal processing part.

13. The computer system according to claim 12, wherein said switch includes negative and positive sides, common terminals connected to the common pins, LAN selecting terminals for connection to the LAN signal processing part, and modem selecting terminals for connection to the modern signal processing part; and the common terminals of the negative and positive sides are connected to one of the LAN selecting terminals and the modem selecting terminals in correspondence to the external connector detected by the connector detector.

14. A method of controlling data communication of a computer system equipped with a LAN signal processing part and a modem signal processing part, comprising the step of:

providing a common connector to which an external LAN connector to be connected to the LAN signal processing part and an external modem connector to be connected to the modem signal processing part are selectively connected;

connecting one of the external LAN connector and the external modem connector to the common connector;

detecting a type of external connector connected to the common connector; and controlling a predetermined signal to be transmitted to one of the LAN signal processing part and the modem signal processing part in correspondence to the type of external connector detected in the detecting step.

15. The method according to claim 14, wherein the detecting step is carried out by a switch provided on an inside wall of the common connector for outputting a detection signal in response to contact with the external LAN connector.

16. The method according to claim 15, wherein said switch outputs a further, different detection signal in response to contact with the external modem connector.

* * * * *